US011891227B2

(12) United States Patent
Lane et al.

(10) Patent No.: US 11,891,227 B2
(45) Date of Patent: Feb. 6, 2024

(54) VERTICAL DISPLACEMENT CONTAINER BASE

(71) Applicant: AMCOR RIGID PACKAGING USA, LLC, Ann Arbor, MI (US)

(72) Inventors: Michael T. Lane, Brooklyn, MI (US); James Stelzer, South Lyon, MI (US)

(73) Assignee: AMCOR RIGID PACKAGING USA, LLC, Ann Arbor, MI (US)

( * ) Notice: Subject to any disclaimer, the term of this patent is extended or adjusted under 35 U.S.C. 154(b) by 165 days.

(21) Appl. No.: 17/423,353

(22) PCT Filed: Jan. 15, 2019

(86) PCT No.: PCT/US2019/013646

§ 371 (c)(1),
(2) Date: Jul. 15, 2021

(87) PCT Pub. No.: WO2020/149832

PCT Pub. Date: Jul. 23, 2020

(65) Prior Publication Data

US 2022/0081149 A1 Mar. 17, 2022

(51) Int. Cl.
*B65D 79/00* (2006.01)
*B65D 1/02* (2006.01)

(52) U.S. Cl.
CPC ..... *B65D 79/0081* (2020.05); *B65D 1/0276* (2013.01); *B65D 2501/0036* (2013.01)

(58) Field of Classification Search
CPC . B65D 79/0081; B65D 1/0276; B65D 1/0284
See application file for complete search history.

(56) References Cited

U.S. PATENT DOCUMENTS 4,134,354 A * 1/1979 Cvacho ..... B21D 51/26 72/379.4
6,942,116 B2 9/2005 Lisch et al.
7,077,279 B2 7/2006 Melrose
(Continued)

FOREIGN PATENT DOCUMENTS

FR 2691648 A1 12/1993
KR 10-2014-0034085 A 3/2014
(Continued)

OTHER PUBLICATIONS

Supplementary European Search Report issued in corresponding EP Patent Application 19910502.4 dated Jul. 19, 2022.
(Continued)

*Primary Examiner* — John K Fristoe, Jr.
*Assistant Examiner* — Jennifer Castriotta
(74) *Attorney, Agent, or Firm* — Harness, Dickey & Pierce, P.L.C.

(57) ABSTRACT

A container including an opening defined by a finish portion. A base is at an end of the container opposite to the opening. The base includes a deep base ring between a standing surface and a truncated cone at a center of the base. The truncated cone is mechanically movable a displacement distance from an as-blown position to a displaced position subsequent to hot-filling and capping of the container to reduce an internal volume of the container. In the displaced position, the truncated cone is closer to the opening than in the as-blown position.

23 Claims, 6 Drawing Sheets

(56) References Cited

U.S. PATENT DOCUMENTS

| | | | | |
|---|---|---|---|---|
| 7,574,846 | B2 | 8/2009 | Sheets et al. | |
| 7,717,282 | B2 | 5/2010 | Melrose | |
| 7,726,106 | B2 | 6/2010 | Kelley et al. | |
| 7,735,304 | B2 | 6/2010 | Kelley et al. | |
| 7,799,264 | B2 | 9/2010 | Trude | |
| 7,900,425 | B2 | 3/2011 | Bysick et al. | |
| 7,926,243 | B2 | 4/2011 | Kelley et al. | |
| 8,011,166 | B2 | 9/2011 | Sheets et al. | |
| 8,028,498 | B2 | 10/2011 | Melrose | |
| 8,047,388 | B2 | 11/2011 | Kelley et al. | |
| 8,047,389 | B2 | 11/2011 | Melrose | |
| 8,096,098 | B2 | 1/2012 | Kelley et al. | |
| 8,127,955 | B2 | 3/2012 | Denner et al. | |
| 8,152,010 | B2 | 4/2012 | Melrose | |
| 8,171,701 | B2 | 5/2012 | Kelley et al. | |
| 8,381,940 | B2 | 2/2013 | Melrose et al. | |
| 8,429,880 | B2 | 4/2013 | Kelley et al. | |
| 8,528,304 | B2 | 9/2013 | Miyazaki et al. | |
| 8,584,879 | B2 | 11/2013 | Melrose et al. | |
| 8,627,944 | B2 | 1/2014 | Kelley et al. | |
| 8,636,944 | B2 | 1/2014 | Kelley et al. | |
| 8,671,653 | B2 | 3/2014 | Kelley et al. | |
| 8,720,163 | B2 | 5/2014 | Melrose et al. | |
| 8,726,616 | B2 | 5/2014 | Bysick et al. | |
| 8,794,462 | B2 | 8/2014 | Trude | |
| 8,893,890 | B2 | 11/2014 | Berger et al. | |
| 9,090,363 | B2 | 7/2015 | Kelley et al. | |
| 9,145,223 | B2 | 9/2015 | Melrose et al. | |
| 9,193,496 | B2 | 11/2015 | Melrose | |
| 9,211,968 | B2 | 12/2015 | Melrose | |
| 9,387,971 | B2 | 7/2016 | Melrose | |
| 9,555,927 | B2 * | 1/2017 | Nakayama | B65D 23/001 |
| 9,624,018 | B2 | 4/2017 | Melrose | |
| 9,731,884 | B2 | 8/2017 | Melrose | |
| 9,764,873 | B2 | 9/2017 | Bysick et al. | |
| 9,802,730 | B2 | 10/2017 | Melrose et al. | |
| 9,834,359 | B2 * | 12/2017 | Bates | B65D 21/0231 |
| 9,878,816 | B2 | 1/2018 | Melrose et al. | |
| 9,884,714 | B2 * | 2/2018 | Godet | B65D 1/0207 |
| 9,969,517 | B2 | 5/2018 | Melrose | |
| 10,005,584 | B2 * | 6/2018 | Tanaka | B65D 1/0276 |
| 10,035,690 | B2 | 7/2018 | Kelley et al. | |
| 10,273,072 | B2 | 4/2019 | Melrose | |
| 10,315,796 | B2 | 6/2019 | Melrose et al. | |
| 10,351,325 | B2 | 7/2019 | Melrose | |
| 10,435,223 | B2 | 10/2019 | Melrose et al. | |
| 10,501,225 | B2 | 12/2019 | Kelley et al. | |
| 10,683,127 | B2 | 6/2020 | Melrose et al. | |
| 10,836,552 | B2 | 11/2020 | Melrose et al. | |
| 11,377,287 | B2 | 7/2022 | Melrose et al. | |
| 2004/0232103 | A1 | 11/2004 | Lisch et al. | |
| 2007/0084821 | A1 | 4/2007 | Bysick et al. | |
| 2009/0134117 | A1 | 5/2009 | Mooney | |
| 2010/0219152 | A1 * | 9/2010 | Derrien | B65D 1/0276 215/374 |
| 2011/0017700 | A1 * | 1/2011 | Patcheak | B65D 1/0276 215/381 |
| 2014/0069937 | A1 | 3/2014 | Melrose et al. | |
| 2014/0224813 | A1 | 8/2014 | Bysick et al. | |
| 2015/0328825 | A1 * | 11/2015 | Bunel | B29C 49/071 264/535 |
| 2016/0075496 | A1 | 3/2016 | Melrose et al. | |
| 2017/0197773 | A1 | 7/2017 | Melrose et al. | |
| 2017/0267392 | A1 | 9/2017 | Woloszyk et al. | |

FOREIGN PATENT DOCUMENTS

| | | | |
|---|---|---|---|
| WO | 2009158307 | A2 | 12/2009 |
| WO | 2014122017 | A1 | 8/2014 |
| WO | 2014122018 | A1 | 8/2014 |
| WO | 2015039690 | A1 | 3/2015 |
| WO | 2015192918 | A1 | 12/2015 |
| WO | 2015193121 | A1 | 12/2015 |
| WO | 2016029016 | A1 | 2/2016 |
| WO | 2016059139 | A1 | 4/2016 |
| WO | 2016087404 | A1 | 6/2016 |
| WO | 2016165960 | A1 | 10/2016 |
| WO | 2016173866 | A1 | 11/2016 |
| WO | 2016207213 | A1 | 12/2016 |
| WO | 2017076617 | A1 | 5/2017 |
| WO | 2018-089908 | A1 | 5/2018 |

OTHER PUBLICATIONS

International Search Report and Written Opinon of the Internatioanl Searching Authority issued in PCT/US2019/013646, dated Oct. 14, 2019; ISA/KR.

Office Action issued in corresponding Colombian Patent Application NC2021/0010340 dated May 26, 2023.

Colombian Office Action regarding Patent Application No. NC20210010340, dated May 26, 2023.

* cited by examiner

| Container | Volume | Base Description | Displacement Distance d1 | Cone Diam R | Cone Dia/Disp Dist | Container Diam c | Container Dia/Cone Dia | Base Ring Height Br | Obtuse Angle Ao | Acute Angle Aa | Outside Wall Angle Aow | Inside Wall Angle Aiw |
|---|---|---|---|---|---|---|---|---|---|---|---|---|
| Design 1 | 20oz | Vertical Displacement | 19.9 | 34.3 | 1.7 | 73.7 | 2.2 | 14.5 | 142.9 | 43.1 | 93.0 | 130.1 |
| Design 2 | 20oz | Vertical Displacement | 22.9 | 30.8 | 1.3 | 73.7 | 2.4 | 16.0 | 151.7 | 30.3 | 91.0 | 119.3 |
| Design 3 | 20oz | Vertical Displacement | 28.3 | 26.5 | 0.9 | 73.7 | 2.8 | 18.7 | 168.5 | 19.5 | 94.0 | 105.5 |
| Design 4 | 20oz | Vertical Displacement | 34.2 | 22.8 | 0.7 | 73.7 | 3.2 | 21.7 | 184.0 | 16.0 | 100.0 | 96.0 |
| Design 5 | 20oz | Vertical Displacement | 26.9 | 28.2 | 1.0 | 73.7 | 2.6 | 18.0 | 164.0 | 24.0 | 94.0 | 110.0 |
| Design 6 | 20oz | Vertical Displacement | 33.2 | 30.5 | 0.9 | 73.7 | 2.4 | 21.2 | 164.0 | 24.0 | 94.0 | 110.0 |
| Design 7 | 28oz | Vertical Displacement | 28.3 | 30.5 | 1.1 | 86.1 | 2.8 | 18.7 | 168.5 | 19.5 | 94.0 | 105.5 |
| Design 8 | 28oz | Vertical Displacement | 35.4 | 29.0 | 0.8 | 86.1 | 3.0 | 22.3 | 167.6 | 20.4 | 94.0 | 106.4 |
| Design 9 | 16oz | Vertical Displacement | 24.4 | 29.6 | 1.2 | 66.1 | 2.2 | 16.7 | 155.9 | 26.2 | 91.0 | 115.2 |
| Averages | - | - | 28.2 | 29.1 | 1.1 | 75.6 | 2.6 | 18.6 | 163.0 | 24.8 | 93.9 | 110.9 |

FIG - 6

VERTICAL DISPLACEMENT CONTAINER BASE

CROSS-REFERENCE TO RELATED APPLICATIONS

This application is the U.S. National Phase Application under 35 U.S.C. 371 of International Application No. PCT/US2019/013646 filed on Jan. 15, 2019. The entire disclosure of the above application is-incorporated herein by reference.

FIELD

The present disclosure relates to a polymeric container including a vertical displacement container base.

BACKGROUND

This section provides background information related to the present disclosure, which is not necessarily prior art.

Containers that are blow molded from various thermoplastics, such as polyethylene terephthalate, are used in the packaging industry to distribute food and beverages to consumers. In order to sterilize the internal product and ensure freshness, a process of hot-filling is used, which requires that the product be heated to temperatures from 180° F. to 205° F. prior to filling the container. After filling, the container is capped to integrally seal the container with a closure. After sealing, the container begins to cool resulting in an internal vacuum within the container.

Various methods have been devised to address the internal container vacuum created by the hot-fill process, such as vacuum panels, nitrogen dosing, compressible ribs and the like. One such method of controlling vacuum is by creating container base designs that move inward to reduce the internal container volume thereby lowering internal vacuum. These base designs can be passive or active. A passive base design allows the internal force of the vacuum to create the inward movement of the base panel. Active base designs require the use of an external mechanical force to reposition or displace the base inwardly. Examples of passive and active base designs can be found in the following U.S. patent documents, each of which is assigned to Amcor and is incorporated herein by reference: U.S. Pat. No. 6,942,116 titled "Container Base Structure Responsive to Vacuum Related Forces" (issued on Sep. 13, 2005); U.S. patent application Ser. No. 15/350,558 filed on Nov. 14, 2016 (Publication No. 2017-0096249 published on Apr. 6, 2017) titled "Lightweight Container Base;" and U.S. patent application Ser. No. 15/505,525 filed on Feb. 21, 2017 titled "Container Base Including Hemispherical Actuating Diaphragm."

Existing active base designs utilize an invertible panel that is substantially horizontal and transversely oriented across the base of the container. This approach allows for internal volume to be displaced through means of a large diameter panel that is inverted a relatively short distance, i.e., a high panel diameter to inversion distance greater than 2:1, such as about 2.3:1. While existing active base designs are suitable for their intended use, they are subject to improvement. The present disclosure advantageously includes a container with an active base having the improvements set forth herein.

SUMMARY

This section provides a general summary of the disclosure, and is not a comprehensive disclosure of its full scope or all of its features.

The present disclosure includes a container including an opening defined by a finish portion. A base is at an end of the container opposite to the opening. The base includes a deep base ring between a standing surface and a truncated cone at a center of the base. The truncated cone is mechanically movable a displacement distance from an as-blown position to a displaced position subsequent to hot-filling and capping of the container to reduce an internal volume of the container. In the displaced position, the truncated cone is closer to the opening than in the as-blown position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 6 sets forth parameters of various containers in accordance with the present disclosure.

Corresponding reference numerals indicate corresponding parts throughout the several views of the drawings.

DETAILED DESCRIPTION

Example embodiments will now be described more fully with reference to the accompanying drawings.

Figure 1:
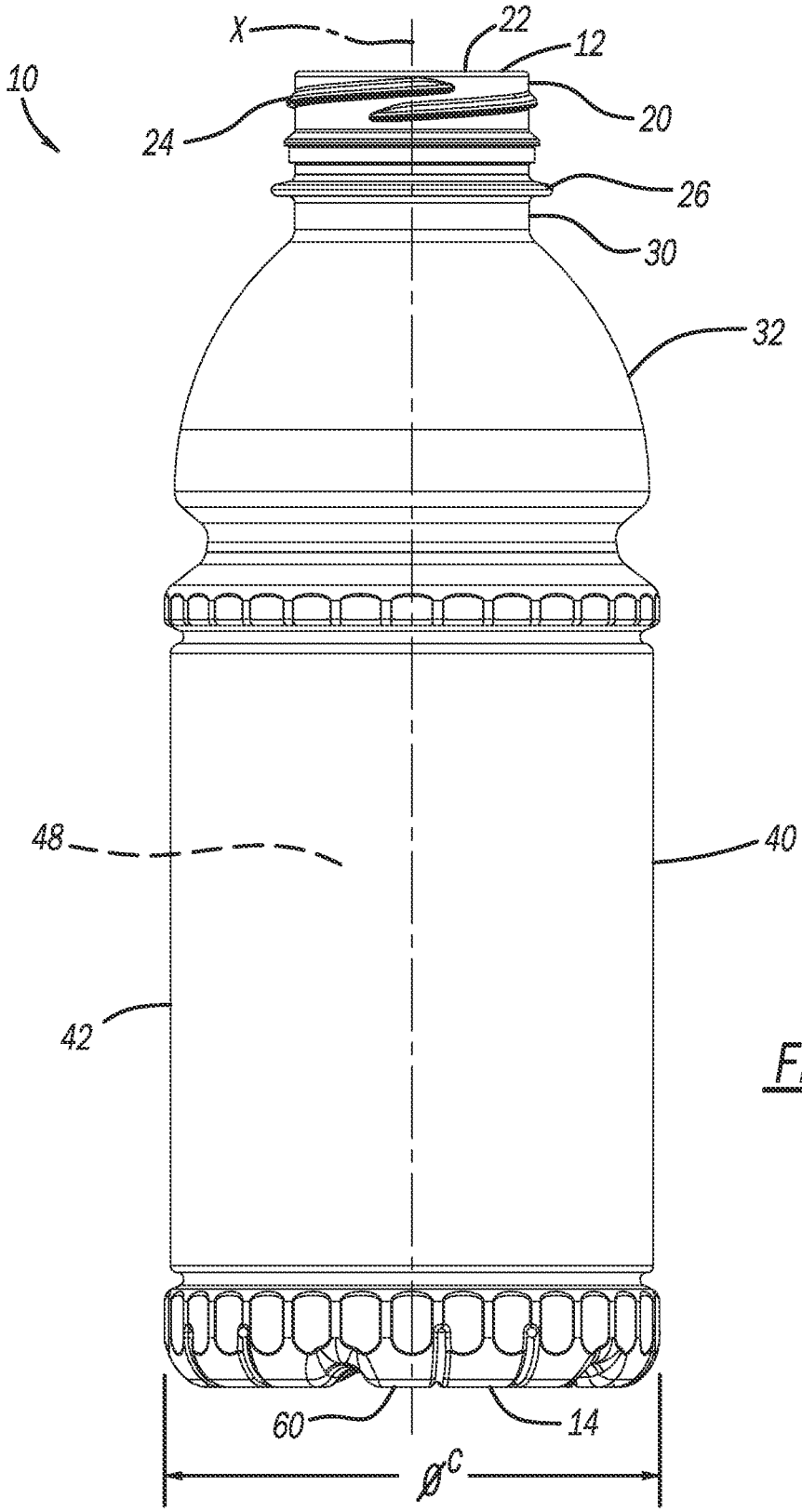
FIG. 1 is a side view of a container in accordance with the present disclosure.
Figure 2:
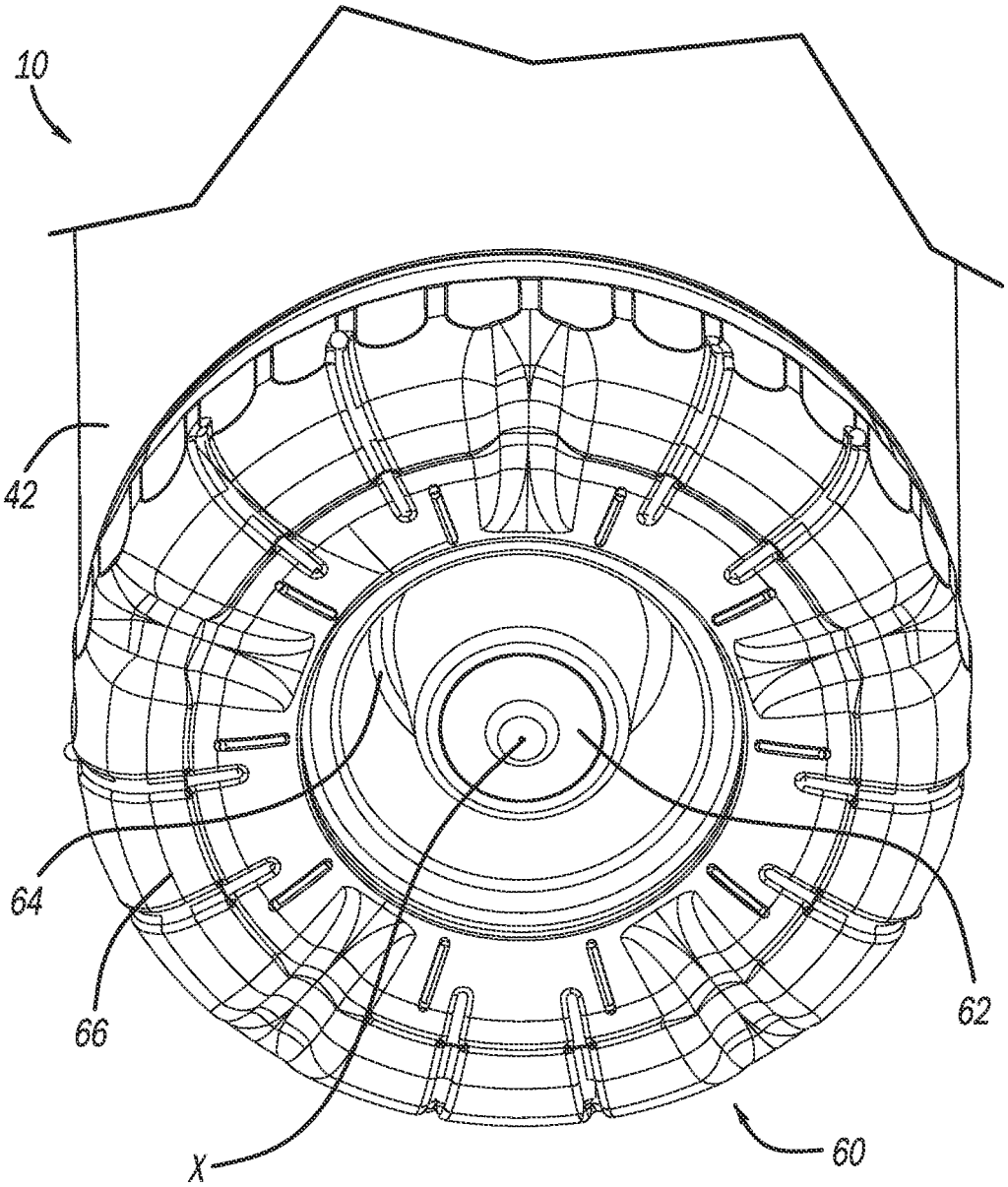
FIG. 2 is a perspective view of a base of the container of FIG. 1, the base including a truncated cone portion in an as-blown position.

FIG. 1 illustrates an exemplary polymeric container in accordance with the present disclosure at reference numeral 10. The container 10 is blow-molded from any suitable preform. The polymeric container 10 may be made of any suitable polymeric material, such as polyethylene terephthalate (PET), low-density polypropylene (LDPP), high-density polyethylene (HDPE), polypropylene, and polystyrene, for example. The material of the container 10 has an average material thickness of 0.011 inches or less. The material of the container 10 has an intrinsic viscosity (IV) of 0.68 deciliters per gram (dL/g)-0.78 dL/g for polyethylene terephthalate.

The container 10 is configured to store any suitable hot-fill material, such as any suitable beverage and/or food product. The container 10 may be of any suitable size, such as, but not limited to, 6, 8, 10, 12, 16, 20 ounces, etc., for example. The container 10 may have any suitable shape, such as, but not limited to, the shape illustrated throughout the figures. The container 10 includes an overall diameter of $Ø^C$.

The exemplary container 10 generally has a first end 12 and a second end 14, which is opposite to the first end 12. A longitudinal axis X extends along a length/height of the container 10 along an axial center of the container 10, which is generally cylindrical. At the first end 12 is a finish 20, which defines an opening 22 of the container 10. The finish 20 includes threads 24, or any other suitable configuration suitable for coupling a closure (e.g., cap) to the finish 20 to seal the opening 22 closed. For example, the threads 24 may be external threads as illustrated, or internal threads in some applications.

Below the finish 20 is a flange 26, which is suitable for holding the preform in a blow-molding machine as the container 10 is formed from the preform. The flange 26 is between the finish 20 and a neck 30. A shoulder 32 extends downward from the neck 30, and outward from the longitudinal axis X. The shoulder 32 extends to a body 40 of the container 10. The body 40 includes a cylindrical sidewall 42, which generally extends to a base 60 of the container 10. The sidewall 42 includes a plurality of ribs. The body 40 defines a majority of an internal volume 48 of the container 10 in which the commodity is stored.

With continued reference to FIG. 1 and additional reference to FIGS. 2-5, the base 60 will now be described in further detail. The base 60 generally includes a truncated cone 62 at an axial center of the base 60. The longitudinal axis A extends through a center of the truncated cone 62. Surrounding the truncated cone 62, and partially defining the truncated cone 62, is a deep base ring 64. The cone 62 and the ring 64 have a diameter OR. The deep base ring 64 extends into the base 60 a distance of BR (see FIG. 4) from the standing surface 66.

Figure 3:
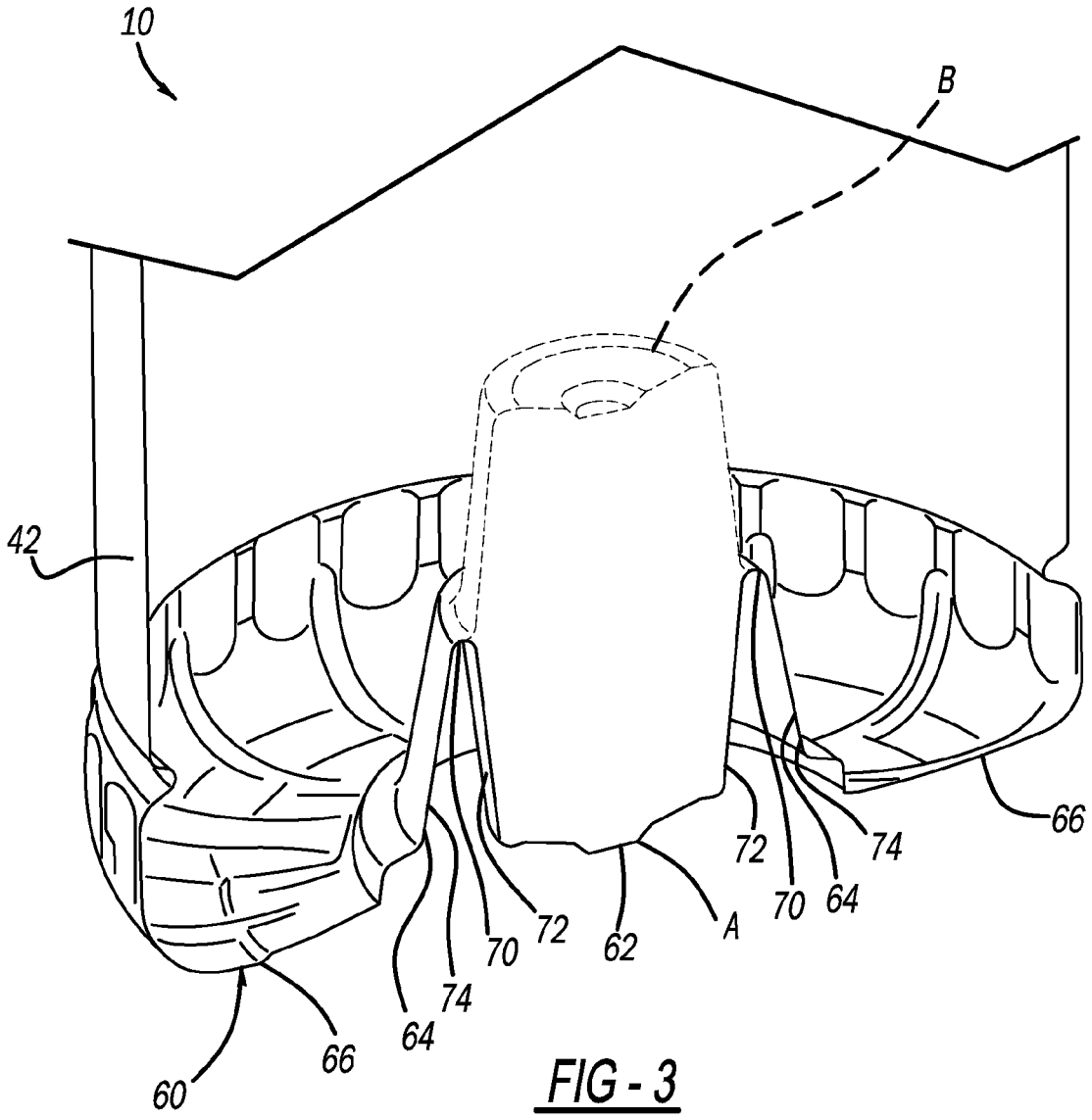
FIG. 3 is a cross-sectional view of the base of the container of FIG. 1, with solid lines illustrating the truncated cone portion in the as-blown position and phantom lines illustrating the truncated cone in a displaced position subsequent to hot-filling and mechanical displacement of the truncated cone.
Figure 4:
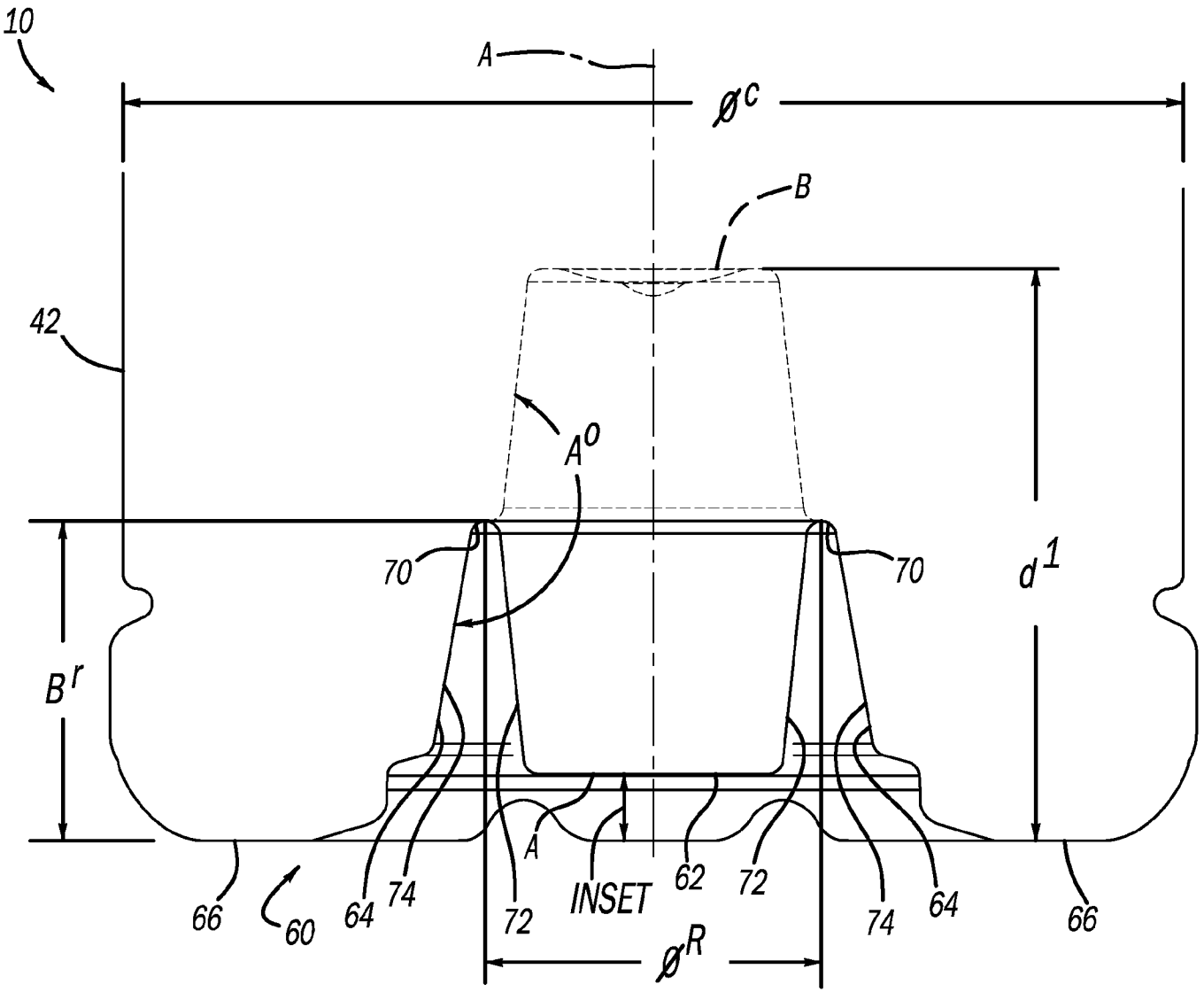
FIG. 4 is another cross-sectional view of the base of the container of FIG. 1, with solid lines illustrating the truncated cone portion in the as-blown position and phantom lines illustrating the truncated cone in the displaced position subsequent to hot-filling and mechanical displacement of the truncated cone.
Figure 5:
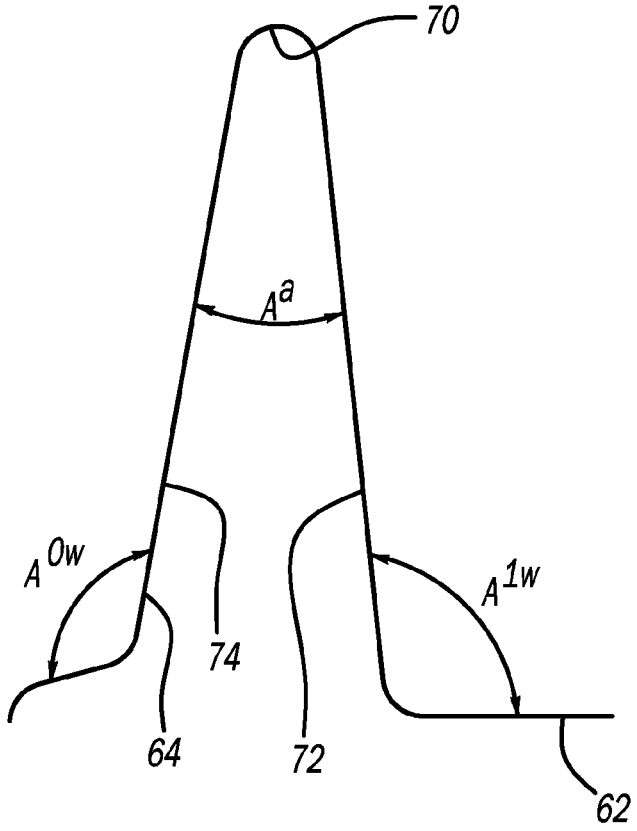
FIG. 5 is a cross-sectional view of a deep base ring of the container of FIG. 1, the deep base ring at least partially defined by the truncated cone portion in the as-blown position.

The deep base ring 64 is between the truncated cone 62 and a standing surface 66. The truncated cone 62 is inset from the standing surface 66 (see FIG. 4, for example). The standing surface 66 provides a surface configured to support the container 10 upright when seated on a flat surface. With particular reference to FIGS. 3-5, the deep base ring 64 includes a hinge 70 from which extends an inner sidewall 72 and an outer sidewall 74. The inner sidewall 72 is also part of the truncated cone 62.

The truncated cone 62 is formed in any suitable manner, such as with any suitable blow-mold with a moveable base insert ring, which is used to create the deep based ring 64 surrounding the truncated cone 62. During blow-molding of the container 10 from the preform, a base insert ring component of a blow mold is in a retracted position relative to the rest of the base tooling, which allows plastic material from the preform to flow into the cavity that is created. The base ring component is then moved into the extended position, which stretches and forms the plastic into the final shape of the deep base ring 64 (see the following U.S. patent, which is assigned to Amcor and incorporated herein by reference: U.S. Pat. No. 8,313,686 titled "Flex Ring Base," issued on Feb. 6, 2009).

FIG. 3 illustrates an as-blown position of the truncated cone 62 at reference letter A. In the as-blown position A, the inner sidewall 72 is opposite to the outer sidewall 74. With reference to FIG. 5, the inner and outer sidewalls 72 and 74 extend from the hinge 70 at an acute angle $A^a$. The acute angle $A^a$ may be any suitable acute angle, such as 16°-43°, and particularly about 25°. The inner sidewall 72 is oriented at an angle $A^{1w}$ from the truncated cone 62 at any suitable obtuse angle, such as 91°-130° as measured from a plane that is generally parallel to the standing surface 66. The outer sidewall 74 is arranged at an angle $A^{0w}$ of 91°-130° as measured from the plane that is generally parallel to the standing surface 66. The angles and depth of the deep base ring 64 can be modified to control material thickness, inversion force, reversion force, and volume displaced of the truncated cone 62.

After the container 10 is hot-filled and the opening 22 is sealed with any suitable closure, the truncated cone 62 is displaced from the as-blown position A to the retracted position B. The truncated cone 62 is displaced to the retracted position B mechanically using any suitable inversion tool, such as a displacement rod that is actuated with a servomotor, hydraulic cylinder, or pneumatic cylinder. In the displaced, retracted position B, the angle between the inner sidewall 72 and the outer sidewall 74 is any suitable obtuse angle $A^0$ of 143°-184°, such as 163° for example (see FIG. 4). Thus the angle between the inner sidewall 72 and the outer sidewall 74 increases from the as-blown position A to the retracted position B a factor of about 3.3-11.5 times, such as about 6.5 times. The truncated cone 62 moves a distance $d^1$ from the as-blown position A to the retracted position B. Mechanical displacement of the truncated cone 62 from the as-blown position A to the retracted position B advantageously reduces the internal volume 48, thereby decreasing vacuum or increasing pressure within the container 10.

The base 60 advantageously has a low cone diameter $Ø^r$ to displacement distance $d^1$ of 2:1 or less. For example, the cone diameter $Ø^r$ to displacement distance $d^1$ can be in the range of 0.2:1 to 2:1, such as about 1:1. The overall container diameter $Ø^c$ to deep base ring diameter $Ø^r$ is about 3:1, such as in the range of 2:1-4:1. The container diameter $Ø^c$ is about three times greater than the displacement distance (or activated depth) $d^1$.

The present disclosure provides numerous advantages over the art. For example, the container 10 having the dimensions and configurations set forth above enables the sidewall 42 and overall material of the container to be made thinner, particularly at the base area 60 (the material of the container 10 has an average material thickness of less than 0.010 inches). This increases the stretch induced crystallinity at the base 60, which is usually an amorphous area due to lower material stretching. The present disclosure allows for more precise control of container volume displacement to create a specific vacuum or pressure level in the container 10, and prevents over pressurization and spilling when the container 10 is opened. Furthermore, the disclosed configuration of the base 60 advantageously increases the force required to revert the truncated cone 62 from the retracted position B to the as-blown position A.

The container 10 advantageously utilizes the centrally located truncated cone 62 that is displaced a relatively long distance $d^1$ compared to the small diameter $Ø^r$ of the truncated cone 62. Thus the container 10 advantageously accomplishes volume reduction of the internal volume 48 using vertically oriented displacement versus transversely oriented inversion.

An advantage of the small diameter of the truncated cone 62 is that there is a large surface area between the deep base ring 64 and the heal/outer diameter of the container 10. The overall container diameter $Ø^c$ to the diameter $Ø^r$ of the deep base ring 64 is about 3:1. This area serves to support the truncated cone 62 when it is in the retracted position (activated/displaced) B so that the truncated cone 62 will not revert if a plurality of the containers are stacked or dropped.

The truncated cone is mechanically displaced to the retracted position B after the container has filled and capped. As the container 10 cools, it may be displaced at various points during cooling depending on requirements of the filling line and the amount of pressure or vacuum that is desired in the container 10 at any given point in the process. This repositioning of the base 60 may occur for example in a labeling machine at the same time an external label is applied to the label or at a dedicated station anywhere within the filling and conveying line. FIG. 6 sets forth parameters of various containers 10 in accordance with the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A container comprising:

an opening defined by a finish portion; and a base at an end of the container opposite to the opening having a maximum diameter, the base including a deep base ring between a standing surface and a truncated cone at a center of the base, the deep base ring including a hinge from which extends an outer sidewall and an inner sidewall, the inner sidewall forms part of the truncated cone, the truncated cone is mechanically movable a displacement distance from an as-blown position to a displaced position subsequent to hot-filling and capping of the container to reduce an internal volume of the container, in the as-blown position the inner sidewall is opposite to the outer sidewall and both the inner sidewall and the truncated cone are below the hinge, in the displaced position both the inner sidewall and the truncated cone are above the hinge and is closer to the opening than in the as-blown position;

wherein:

the container is made of a polymeric material having an average material thickness of 0.011" or less; and a ratio of a maximum diameter of the truncated cone to the displacement distance is less than 2:1.

2. The container of claim 1, wherein the maximum diameter of the truncated cone is about equal to the displacement distance.

3. The container of claim 1, wherein the outer sidewall of the deep base ring is angled 91°-130° from a plane extending parallel to the standing surface.

4. The container of claim 3, wherein the standing surface extends perpendicular to a longitudinal axis of the container.

5. The container of claim 1, wherein in the as-blown position the inner sidewall and the outer sidewall are arranged relative to each other at an angle of 16° to 43°.

6. The container of claim 1, wherein in the displaced position the inner sidewall and the outer sidewall are arranged relative to each other at an angle of 143° to 184°.

7. The container of claim 1, wherein in the as-blown position the inner sidewall and the outer sidewall are arranged relative to each other at an average angle of 25°.

8. The container of claim 7, wherein in the displaced position the inner sidewall and the outer sidewall are arranged relative to each other at an average angle of 163°.

9. The container of claim 1, wherein in the displaced position the inner sidewall and the outer sidewall are arranged at an obtuse angle that is 3.3-11.5 times greater than an acute angle at which the inner sidewall and the outer sidewall are arranged in the as-blown position.

10. The container of claim 1, wherein in the displaced position the inner sidewall and the outer sidewall are arranged at an obtuse angle that is 6.5 times greater than an acute angle at which the inner sidewall and the outer sidewall are arranged in the as-blown position.

11. The container of claim 1, wherein the container has an overall diameter that is about two to four times greater than a maximum diameter of the deep base ring.

12. The container of claim 1, wherein the container has an overall diameter that is about three times greater than a maximum diameter of the deep base ring.

13. The container of claim 1, wherein the container has an overall diameter that is about three times greater than the displacement distance.

14. The container of claim 1, the polymeric material has an intrinsic viscosity of 0.68-0.78 deciliters per gram (dL/g).

15. The container of claim 1, wherein the base diameter is between two and three times greater than the cone diameter.

16. The container of claim 1, wherein a wall thickness of the deep base ring is 0.011 inches or less.

17. The container of claim 1, wherein the truncated cone is inset from the standing surface in the as-blown position.

18. A container comprising:

an opening defined by a finish portion; and a base at an end of the container opposite to the opening, the base including a deep base ring between a standing surface and a truncated cone at a center of the base, the deep base ring including a hinge from which extends an outer sidewall and an inner sidewall, the inner sidewall forms part of the truncated cone, the truncated cone is mechanically movable a displacement distance from an as-blown position to an displaced position subsequent to hot-filling and capping of the container to reduce an internal volume of the container, in the as-blown position the inner sidewall is opposite to the outer sidewall and both the inner sidewall and the truncated cone are below the hinge, in the displaced position both the inner sidewall and the truncated cone are above the hinge and closer to the opening than in the as-blown position;

wherein the container has an overall diameter that is about three times greater than the displacement distance.

19. The container of claim 18, wherein the truncated cone has a maximum diameter that is not more than twice the displacement distance.

20. The container of claim 18, wherein the container is made of a polymeric material having an average material thickness of less than 0.011".

21. The container of claim 18, wherein the outer sidewall of the deep base ring is angled 91°-130° from the standing surface.

22. The container of claim 18, wherein in the displaced position the inner sidewall and the outer sidewall are arranged at an obtuse angle, and in the as-blown position the inner sidewall and the outer sidewall are arranged at an acute angle.

23. The container of claim 18, wherein a base diameter is at least 2 times greater than a cone diameter.

* * * * *